US007252551B2

(12) United States Patent
Ueno et al.

(10) Patent No.: US 7,252,551 B2
(45) Date of Patent: Aug. 7, 2007

(54) ELECTRONIC PART-INCORPORATING CONNECTOR AND WIRING HARNESS WITH ELECTRONIC PART-INCORPORATING CONNECTOR

(75) Inventors: Seiichi Ueno, Tokyo (JP); Takenobu Yabu, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/368,595

(22) Filed: Mar. 7, 2006

(65) Prior Publication Data

US 2006/0208583 A1 Sep. 21, 2006

(30) Foreign Application Priority Data

Mar. 9, 2005 (JP) ..... 2005-066216
Oct. 6, 2005 (JP) ..... 2005-293448

(51) Int. Cl.
*H01R 13/66* (2006.01)

(52) U.S. Cl. ..... 439/620.21; 439/404

(58) Field of Classification Search ..... 439/701, 439/404, 214, 620.22, 658, 620.21
See application file for complete search history.

(56) References Cited

U.S. PATENT DOCUMENTS 4,760,357 A * 7/1988 Yamaguchi ..... 333/181
5,118,308 A * 6/1992 Liu et al. ..... 439/620.21
5,154,639 A * 10/1992 Knoll et al. ..... 439/620.21
5,577,937 A * 11/1996 Itoh et al. ..... 439/620.22
5,984,728 A * 11/1999 Chen et al. ..... 439/620.22
6,095,867 A * 8/2000 Brandt et al. ..... 439/620.09
6,109,973 A * 8/2000 Gronowicz et al. .... 439/620.21
6,371,793 B1 * 4/2002 Doorhy et al. ..... 439/404
6,454,584 B1 * 9/2002 Milan ..... 439/214
6,988,909 B2 * 1/2006 Morizaki ..... 439/404

FOREIGN PATENT DOCUMENTS

EP 1478053 * 11/2003
JP 2004-172072 6/2004

* cited by examiner

*Primary Examiner*—Tulsidas C. Patel
*Assistant Examiner*—Harshad C Patel
(74) *Attorney, Agent, or Firm*—Oblon, Spivak, McClelland, Maier & Neustadt, P.C.

(57) ABSTRACT

There is provided an electronic part incorporating connector in which an electronic part and a connecting part for connecting a lead of the electronic part to an electric wire are housed in a housing, wherein the housing is divided into a first housing for housing the electronic part and a second housing for housing the connecting part, and by connecting the first housing and the second housing to each other, the lead of the electronic part is connected to the connecting part.

14 Claims, 11 Drawing Sheets

ELECTRONIC PART-INCORPORATING CONNECTOR AND WIRING HARNESS WITH ELECTRONIC PART-INCORPORATING CONNECTOR

TECHNICAL FIELD

The present invention relates to a connector incorporating an electronic part (integrated circuit etc.), which is used for a vehicular wire harness or the like, and a wiring harness with electronic part incorporating connector which uses the said connector.

BACKGROUND OF THE INVENTION

A motor vehicle is mounted with a large number of actuators formed by a motor, a solenoid, and the like as electric equipment, and a control system for decentralized controlling the electric equipment independently by means of data communication has already been developed. In this system, a wiring harness as shown in FIG. 13 is used.

This wiring harness 10 is constructed by installing many connectors 14 on a combination wire 12, in which a plurality of electric insulated wires are collected, at desired intervals in the lengthwise direction, and is called a so-called bus wiring wire harness. Each of the connectors 14 in this wiring harness 10 is inserted in and connected to a connector 18 (equipment-side connector) on the electric equipment 16 side mounted at portions of a vehicle.

The connector 14 on the wiring harness 10 side incorporates a circuit board that identifies, among signals being transmitted through a combination wire 12, a signal (address) to the electric equipment to which the connector 14 is connected to carry out the control of the electric equipment (Unexamined Japanese Patent Publication No. 2004-172072). The connector of this type is also called a smart connector.

In recent years, as to the connector of this type, the incorporating of a communication control IC (integrated circuit) in place of the circuit board has been studied. However, since the communication control IC and other electronic parts are relatively expensive, if a trouble is found after the communication control IC has been incorporated, the expensive communication control IC may become wasteful. This decreases the yield of assembling process, resulting in an increase in cost.

SUMMARY OF THE INVENTION

An electronic part incorporating connector in accordance with the present invention is a connector in which an electronic part and a connecting part for connecting a lead of the electronic part to an electric wire are housed in a housing, characterized in that the housing is divided into a first housing for housing the electronic part and a second housing for housing the connecting part, and by connecting the first housing and the second housing to each other, the lead of the electronic part is connected to the connecting part.

DETAILED DESCRIPTION OF THE INVENTION

Figure 1:
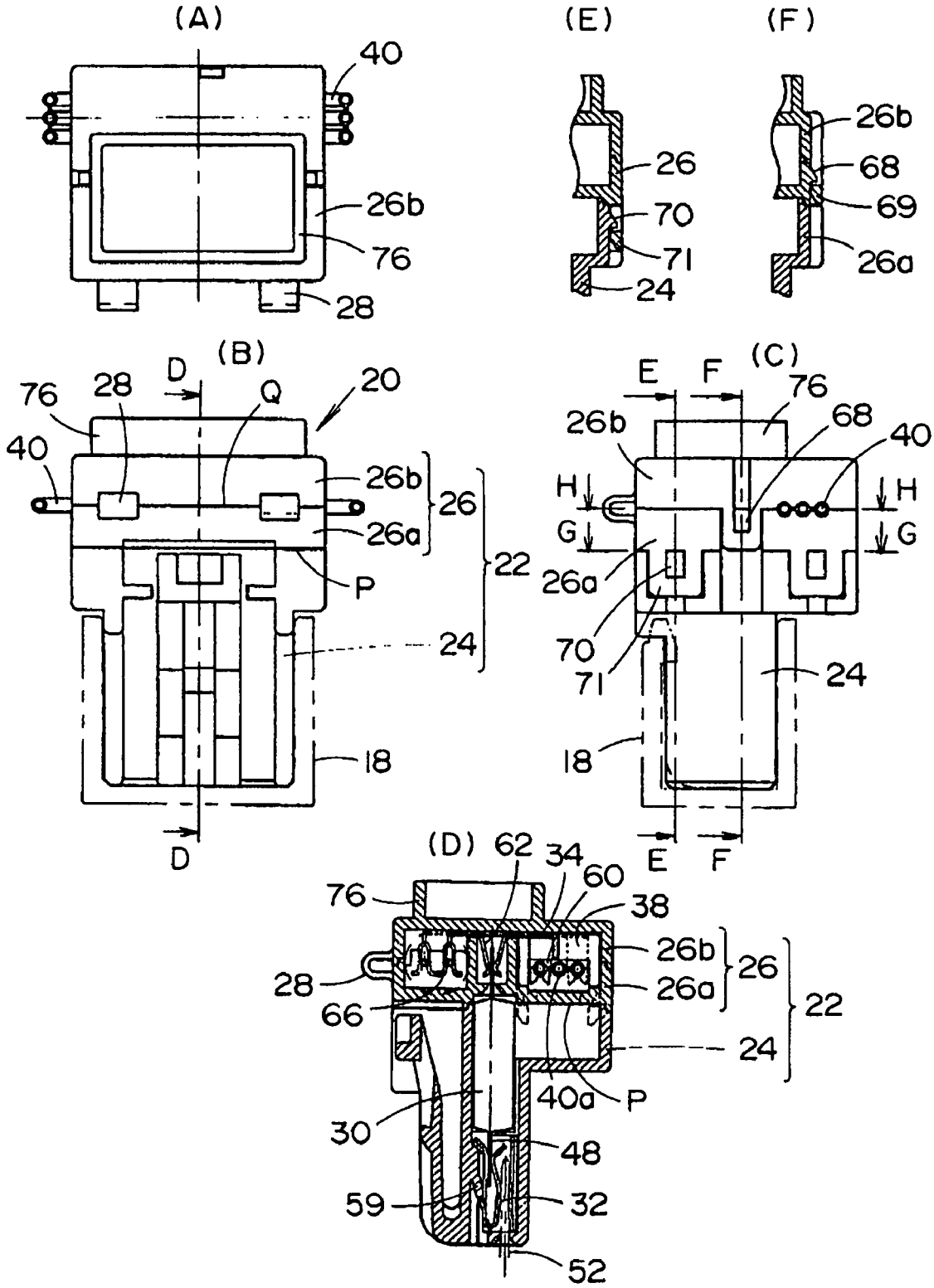
FIG. 1 is views showing one embodiment of an electronic part incorporating connector in accordance with the present invention, FIG. 1(A) being a plan view, FIG. 1(B) being a front view, FIG. 1(C) being a side view, FIG. 1(D) being a sectional view taken along the line D-D of FIG. 1(B), FIG. 1(E) being a sectional view taken along the line E-E of FIG. 1(C), and FIG. 1(F) being a sectional view taken along the line F-F of FIG. 1(C)
Figure 2:
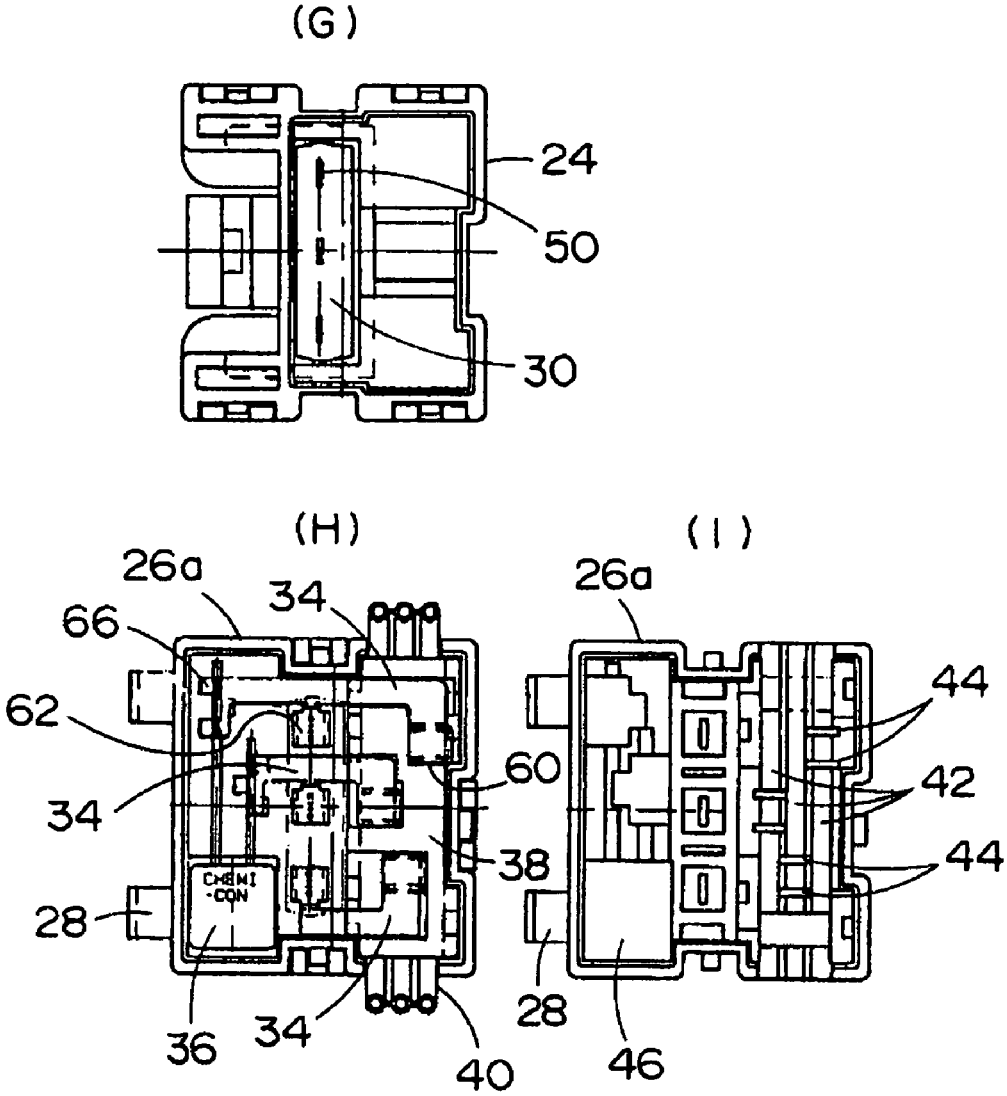
FIG. 2(G) is a sectional view taken along the line G-G of FIG. 1(C)
FIG. 2(H) is a sectional view taken along the line H-H of FIG. 1(C)
FIG. 2(I) is a plan view showing a state before a part is incorporated in the body of a second housing, showing the same plane as FIG. 2(H)

FIGS. 1 to 4 show one embodiment of an electronic part incorporating connector in accordance with the present invention. In this embodiment, an explanation is given of the case where the electronic part incorporated in the connector is a relatively expensive communication control IC. However, the electronic part incorporated in the connector may be an electronic part other than the communication control IC. This electronic part incorporating connector 20 includes a housing 22 for housing various parts. This housing 22 is divided into a first housing 24 and a second housing 26, and the second housing 26 is further divided into a body 26*a* and a lid 26*b*. The body 26*a* and the lid 26*b* are connected to each other by hinge portions 28 so as to be capable of being opened and closed. The hinge portions 28 are not necessarily needed.

In the first housing 24, a communication control IC 30 (electronic part) and a two-way female connecting terminal 32 (equipment-side connecting part) are incorporated. In the second housing 26, a bus bar connector 34 (wire-side connecting part), a capacitor 36 (another electronic part), an electric wire pressing element 38, and the like are incorporated. In some cases, other parts are further incorporated. The capacitor 36 is incorporated as necessary, and is sometimes omitted. Also, the second housing 26 is constructed so that a combination wire 40 passing through the housing 26 is held by the body 26*a* and the lid 26*b*. In this example, the combination wire 40 is formed by three electric wires 40*a* (power line, grounding line, signal line) arranged in parallel. As shown in FIG. 2(I), in the top surface of the body 26*a*, wire positioning grooves 42, solderless terminal insertion slots 44, a capacitor housing concave portion 46, and the like are formed.

Figure 3:
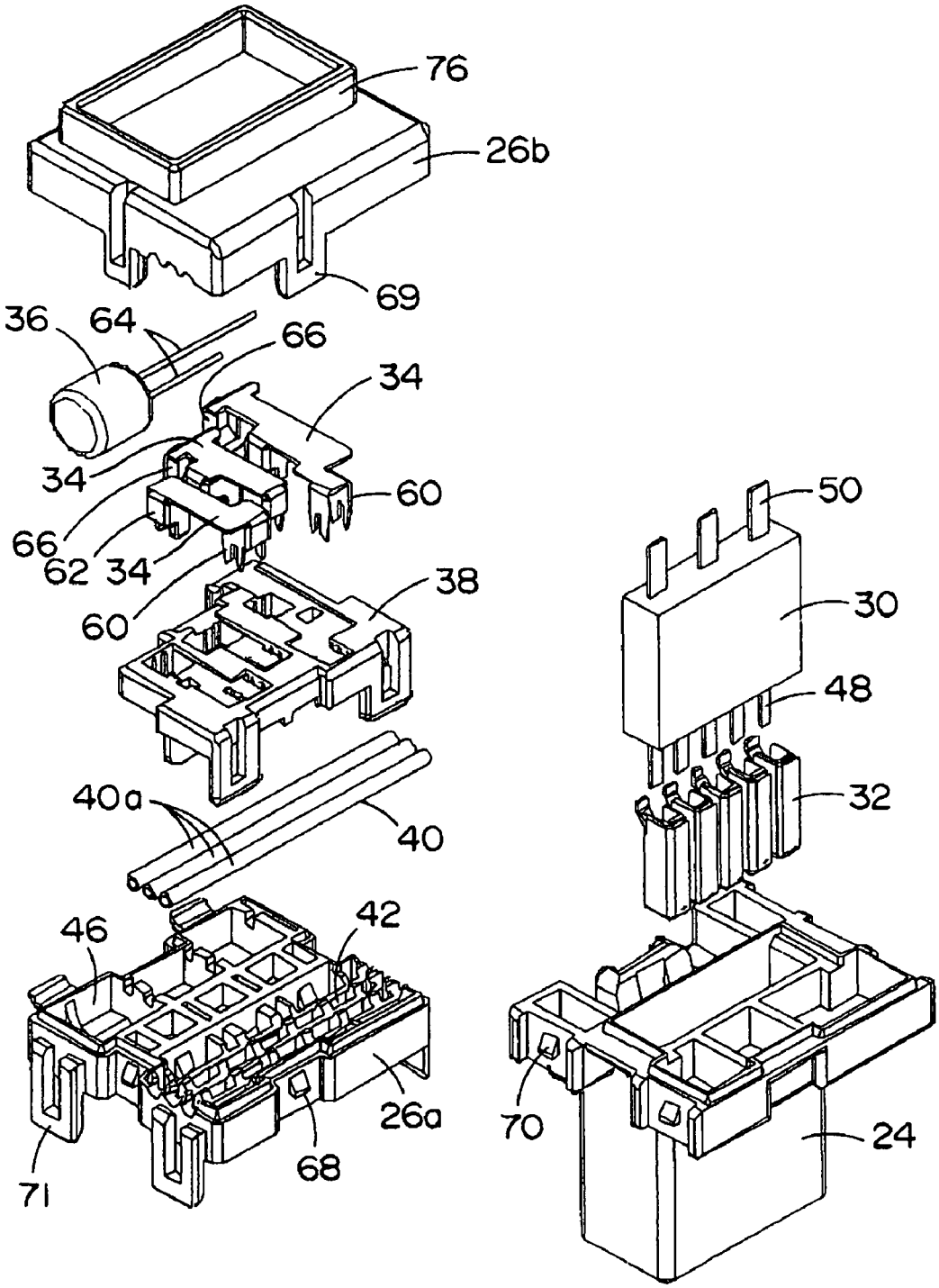
FIG. 3 is an exploded perspective view of the electronic part incorporating connector shown in FIG. 1.

The communication control IC 30 identifies, among signals being transmitted through a combination wire 12, a signal (address) to equipment (motor etc.) to which the electronic part incorporating connector 20 is connected and carries out the control of the equipment. As shown in FIG. 3, the communication control IC 30 has, for example, five equipment-side leads 48 on the front end side, and has three wire-side leads 50 on the rear end side. The equipment-side leads 42 and the wire-side leads 44 extend in a straight line form in the direction opposite to each other.

Figure 5:
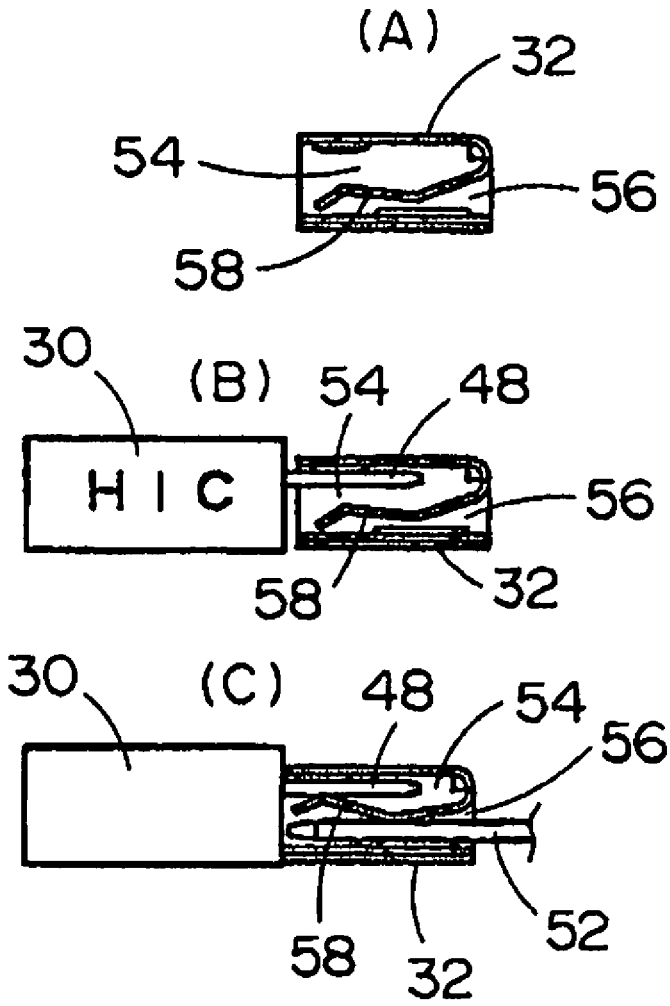
FIG. 5(A) is a sectional view of a two-way female connecting terminal used as the electronic part incorporating connector shown in FIG. 1.
FIG. 5(B) is a sectional view showing a state in which an equipment-side lead of a communication control 1C is inserted in the connector.
FIG. 5(C) is a sectional view showing a state in which a male terminal of an equipment-side connector is further inserted.
Figure 13:
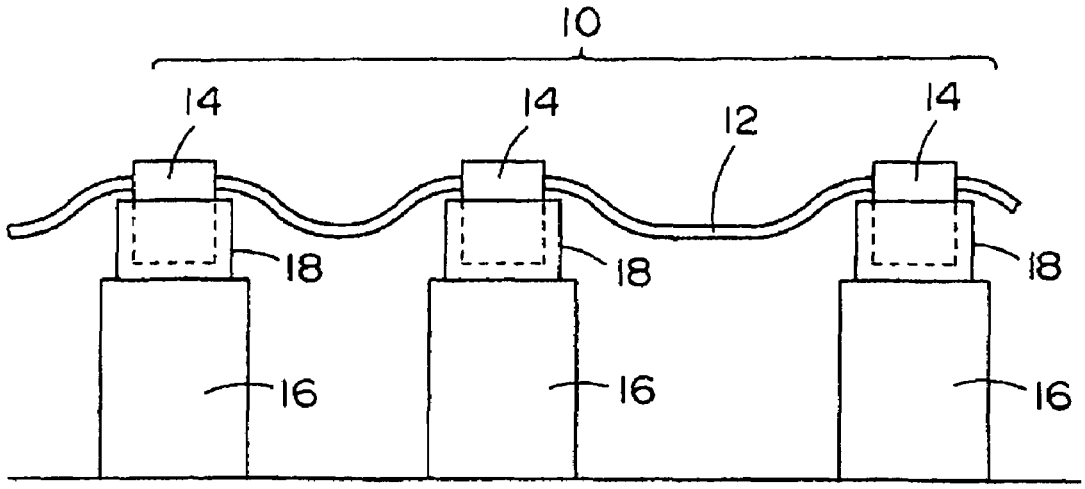
FIG. 13 is an explanatory view showing a state in which a wiring harness with conventional connector is being used.

The two-way female connecting terminal 32 connects the equipment-side leads 48 of the communication control IC 30 to a male terminal 52 (refer to FIG. 1(D)) of an equipment-side connector 18 (two-dot chain line in FIGS. 1(B) and 1(C), refer to FIG. 13). As shown in FIG. 5, the two-way female connecting terminal 32 is provided alternately with an insertion portion 54 for the equipment-side leads 48 of the communication control IC 30 and an insertion portion 56 for the male terminal 52 of the equipment-side connector. Between the insertion portion 54 and the insertion portion 56, an elastic tongue element 58 folded back from the inlet side of the insertion portion 56 on the equipment side is provided. This elastic tongue element 58 is formed so that in the state in which the equipment-side leads 50 of the communication control IC 30 are inserted in the insertion portion 54 on the IC side and nothing is inserted in the equipment-side insertion portion 56 as shown in FIG. 5(B), the elastic tongue element 58 does not come into contact with the equipment-side leads 48, but if the male terminal 52 is inserted in the insertion portion 56 on the equipment side as shown in FIG. 5(C), the elastic tongue element 58 is pushed away by the male terminal 52 and comes into contact with the equipment-side leads 50, by which an elastic repulsive force necessary for electrical connection is generated. The elastic tongue element 58 may be formed so that when the equipment-side leads 48 are inserted in the elastic tongue element 58 as shown in FIG. 5(B), the elastic tongue element 58 comes into contact with the equipment-side leads 48 with a contact pressure lower than the contact pressure necessary for electrical connection.

Figure 4:
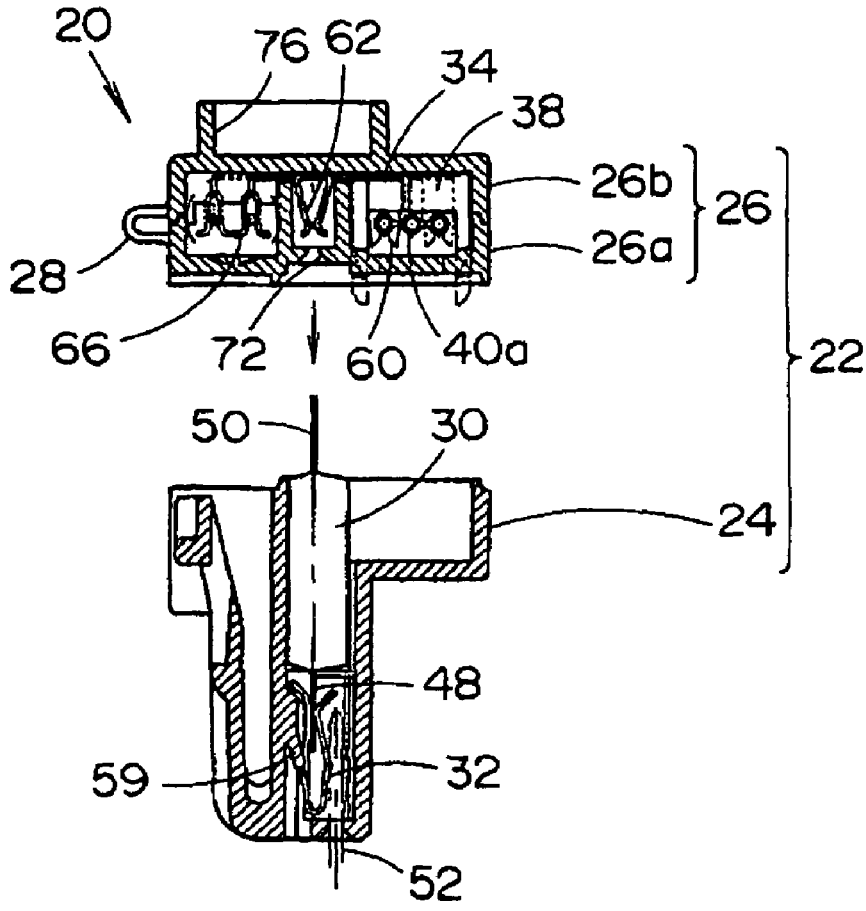
FIG. 4 is a sectional view of the electronic part incorporating connector shown in FIG. 1, showing a state before first and second housings are connected to each other.

The two-way female connecting terminal 32 is incorporated in the first housing 24 before the communication control IC 30 is incorporated. As shown in FIGS. 1(D) and 4, in order for the two-way female connecting terminal 32 to receive the insertion force of the male terminal 52, the first housing 24 is provided with a lance 59 for locking the two-way female connecting terminal 32. When the communication control IC 30 is incorporated in the first housing 24, as shown in FIG. 5(B), the equipment-side leads 48 do not come into contact with the elastic tongue element 58 (or come into contact merely with a low contact pressure), so that the equipment-side leads 48 can be inserted in the two-way female connecting terminal 32 with no insertion force (or with a small insertion force). Also, when the assembled connector 20 is fitted in the equipment-side connector 18, the two-way female connecting terminal 32 incorporated in the first housing 24 receives the insertion force of the male terminal 52, so that the insertion force is not exerted on the equipment-side leads 48 of the communication control IC 30. Therefore, the communication control IC 30 can be protected securely. Also, by this configuration, in the case where the necessity of removing the communication control IC 30 housed in the first housing 24 for any reason arises, the communication control IC 30 and the like electronic part can easily be removed from the first housing 24.

On the other hand, the bus bar connector 34 incorporated in the second housing 26 is formed of one conductive sheet integrally with a solderless terminal 60 connected under pressure to the individual electric wire 40*a* constituting the combination wire 40 and a female terminal 62 to which the wire-side leads 50 of the communication control IC 30 are connected.

In this example, three bus bar connectors 34 are provided in order to connect the wire-side leads 50 of the communication control IC 30 and the electric wires 40*a* to each other one to one. Also, in the case where the capacitor 36 is incorporated, a spring terminal 66 to which leads 64 of the capacitor 36 are connected is also provided on two of the three bus bar connectors 34.

When a part is incorporated in the second housing 26, first, the electric wires 40*a* are arranged above the wire positioning grooves 42 (refer to FIG. 2(I)) of the body 26*a*. Then, as shown in FIG. 6(A), the electric wires 40*a* are pressed by the electric wire pressing element 38, and the capacitor 36 is incorporated in the capacitor housing concave portion 46 (refer to FIG. 2(I)). Subsequently, as shown in FIG. 6(B), the bus bar connectors 34 are incorporated. The electric wire pressing element 38 has grooves or holes for positioning the bus bar connectors 34 (refer to FIG. 3). When the bus bar connectors 34 are incorporated, the solderless terminals 60 are connected under pressure to the electric wires 40*a*, the spring terminals 66 are connected to the leads 64 of the capacitor 36, and the female terminals 62 are positioned at positions capable of being connected to the wire-side leads of the communication control IC 30. Thereafter, the lid 26*b* is closed, and the body 26*a* and the lid 26*b* are connected to each other. Thereby, a state in which the body 26*a* and the lid 26*b* hold the combination wire 40 therebetween is formed (refer to FIGS. 1 and 4). The body 26*a* and the lid 26*b* can be connected by using locking claws 68 and hooking portions 69 (snap fit) as shown in FIG. 1(F).

The configuration may be such that when the bus bar connectors 34 are incorporated, first, the bus bar connectors 34 are positioned and temporarily locked to the electric wire pressing element 38, and then the bus bar connectors 34 are fixed, by which the solderless terminals 60 are connected under pressure to the electric wires 40*a*, and the spring terminals 66 are connected to the leads 64 of the capacitor 36. Also, the bus bar connectors 34 may be fixed when the lid 26*b* is closed and the body 26*a* and the lid 26*b* are connected to each other.

Figure 6:
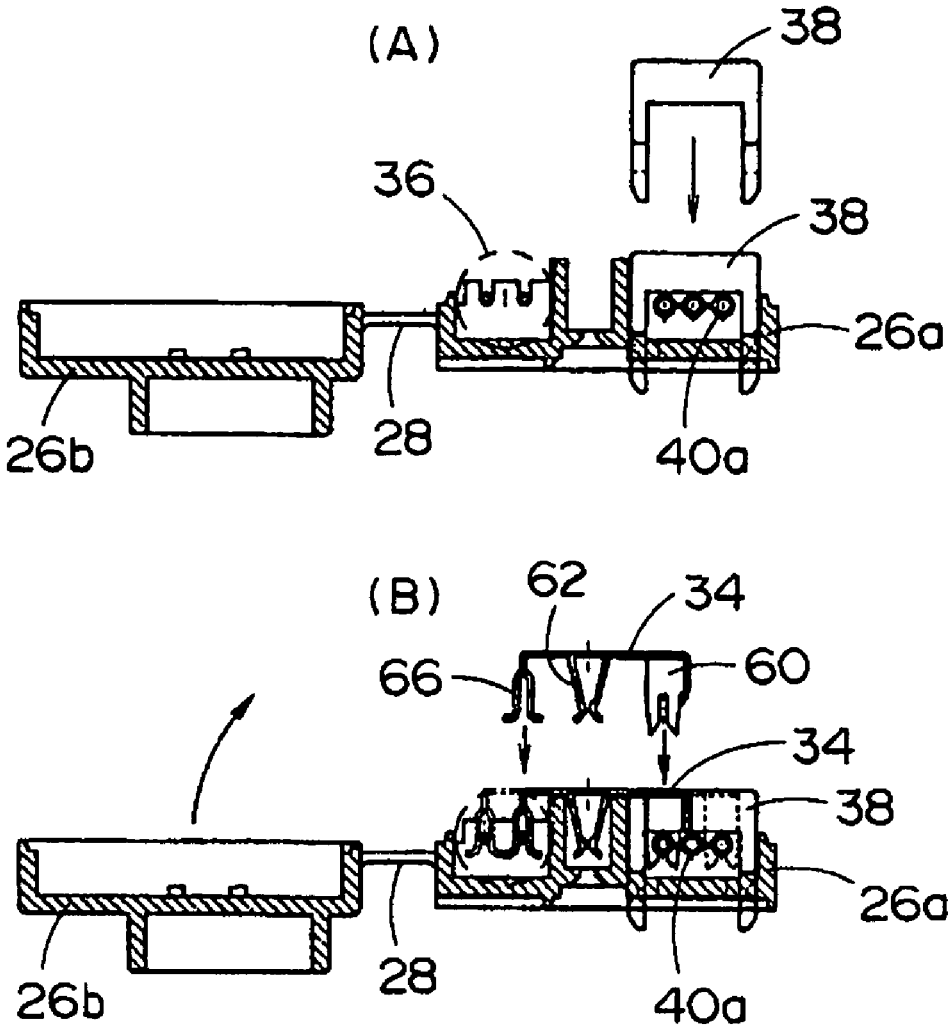
FIGS. 6(A) and 6(B) are sectional views showing one example of a process for incorporating a part in a body of a second housing of the electronic part incorporating connector shown in FIG. 1.
Figure 7:
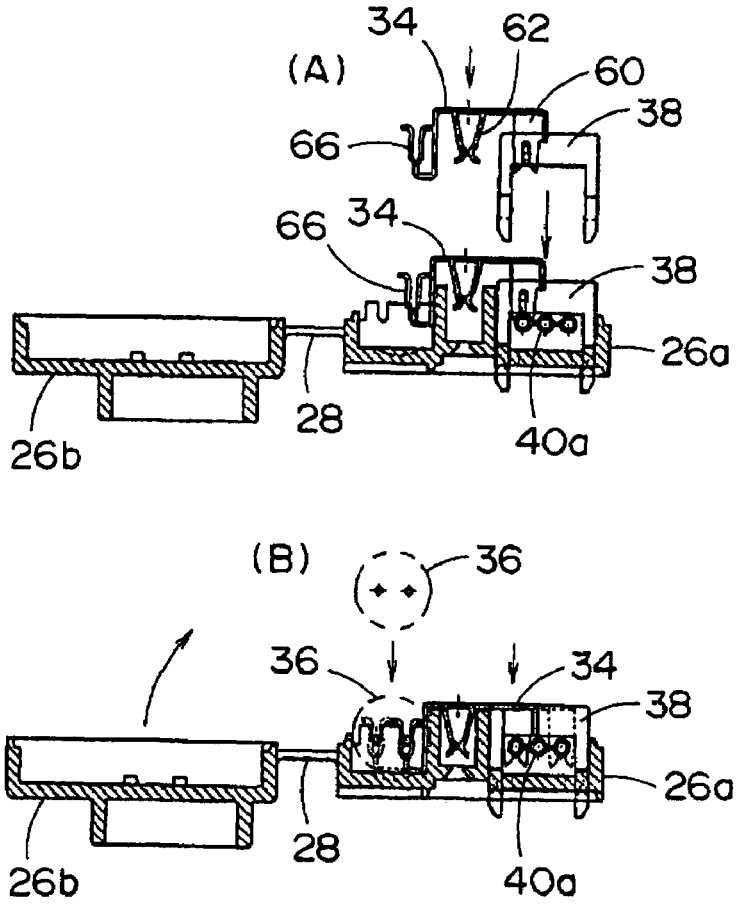
FIGS. 7(A) and 7(B) are sectional views showing another example of a process for incorporating a part in the body of a second housing of the electronic part incorporating connector shown in FIG. 1.

FIG. 6 shows a case where the bus bar connectors 34 are incorporated after the capacitor 36 has been incorporated in the body 26*a*. However, as shown in FIGS. 7(A) and 7(B), if the spring terminals 66 of the bus bar connectors 34 are formed so as to be directed to the upside, the capacitor 36 can also be incorporated after the bus bar connectors 34 have been incorporated.

When both of the housings 24 and 26 are connected to each other after necessary parts have been incorporated in the first housing 24 and the second housing 26 as described above, the wire-side leads 50 of the communication control IC 30 are inserted in the female terminals 62 of the bus bar connectors 34. The first housing 24 and the second housing 26 can be connected by using locking claws 70 and hooking portions 71 (snap fit) as shown in FIG. 1(E). When the first housing 24 and the second housing 26 are connected to each other, in order to insert the wire-side leads 50 in the female terminals 62 surely and reasonably, bellmouths 72 are formed at positions corresponding to the female terminal 62 on the lower surface (the surface opposed to the first housing 24) of the second housing 26. When the first housing 24 and the second housing 26 are connected to each other, the three wire-side leads 50 of the communication control IC 30 are connected to the three electric wires 40*a* one to one via the three bus bar connectors 34, by which the electronic part incorporating connector 20 is completed.

Figure 8:
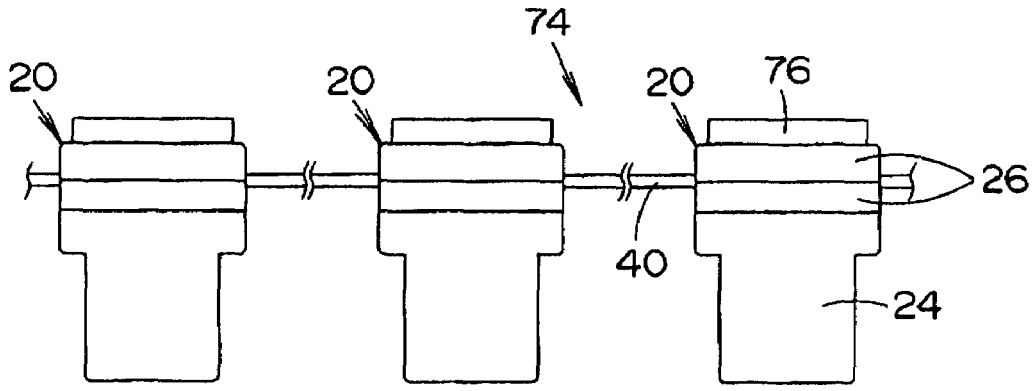
FIG. 8 is a front view showing one embodiment of a wiring harness with electronic part incorporating connector in accordance with the present invention.

FIG. 8 shows a wiring harness 74 formed by installing many electronic part incorporating connectors 20 on the combination wire 40. In the case where such a wiring harness 74 is assembled, the assembly on the first housing 24 side and the assembly on the second housing 26 side are accomplished in separate processes, and the inspection of the second housing 26 side is carried out in a state of a semifinished product in which many second housings 26 are installed to the combination wire 40 to check to ensure that no trouble is present. Then, the first housing 24 can be connected to the second housing 26. That is to say, since the expensive communication control IC 30 can be incorporated at the final stage, there is less possibility that the communication control IC 30 becomes wasteful due to a trouble etc. of other parts. Also, if the necessity of removing the communication control IC 30 for any reason arises after the assembly of the wiring harness 74 has been finished, the communication control IC 30 can easily be removed by merely separating the first housing 24 from the second housing 26. In particular, in the case where the two-way female connecting terminal 32 is used in the first housing 24, the communication control IC 30 can be removed from the first housing 24 very easily.

In order to judge whether the assembly of the second housing 26 has been accomplished completely, the continuity test between the bus bar connector 34 and each wire of the combination wire 40 and between the bus bar connector 34 and the lead 64 of the electronic part (for example, the capacitor 36) is suitable. To perform the continuity test, it is desirable that conductive portions of the bus bar connector 34 and the electronic part (for example, the capacitor 36) be exposed suitably in the state shown in FIG. 7(B). The above-described embodiment has an advantage that the inspection contact in the electronic part incorporating connector 20 can be provided at an arbitrary position of, for example, the bus bar connector 34 because the housing is divided into the first housing 24 and the second housing 26. In this case, the terminal of each wire may be used as the inspection contact on the combination wire 40 side. The terminal of each wire may be a terminal incorporated in a connector, not shown.

Even in the state shown in FIG. 4, the continuity test can be performed. For example, an inspection contactor may be inserted in the bellmouth 72 of the second housing 26 so that the inspection contact of the bus bar connector 34 is the female terminal 62, or the bus bar connector 34 may be extended to lead through the inspection contact within the range of joint of the housing.

Figure 9:
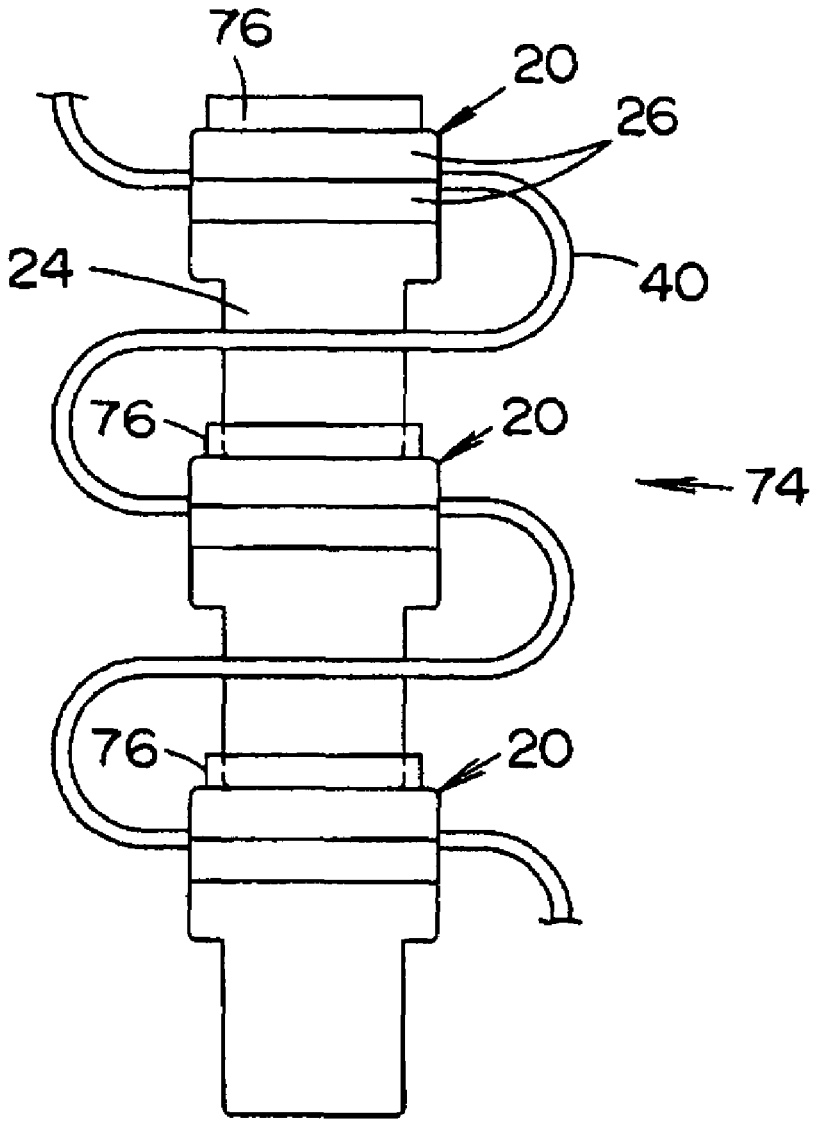
FIG. 9 is a front view showing a state in which the electronic part incorporating connectors of the wiring harness shown in FIG. 8 are connected to each other.

On the top surface of the second housing 26 of the electronic part incorporating connector 20, a rectangularly-shaped frame 76 is formed. This frame 76 connects the electronic part incorporating connectors 20 as shown in FIG. 9. When the wiring harness 74 is shipped, if the wiring harness 74 is shipped in the state in which the electronic part incorporating connectors 20 are connected as shown in FIG. 9, when the electronic part incorporating connector 20 is installed to a motor vehicle, it can be installed by separating the connector from the connecting body successively one by one. Therefore, entangling of wire is less liable to occur, and the assembling work can be performed easily. Also, the assembling work can be automated easily by using a robot.

The electronic part incorporating connector of this type is required to have waterproofness of a degree of drip-proofness though being not required to have complete waterproofness. In this electronic part incorporating connector 20, a joint P between the first housing 24 and the second housing 26 can be formed by a plane having no irregularities in the circumferential direction. Therefore, the waterproofness of this portion can be secured relatively easily, for example, by a difference in height in the wall thickness direction formed at the joint P. A problem is a joint Q between the body 26*a* and the lid 26*b* of the second housing 26. Since this joint Q is a portion for holding the electric wires 40*a*, water may intrude from this portion.

Figure 10:
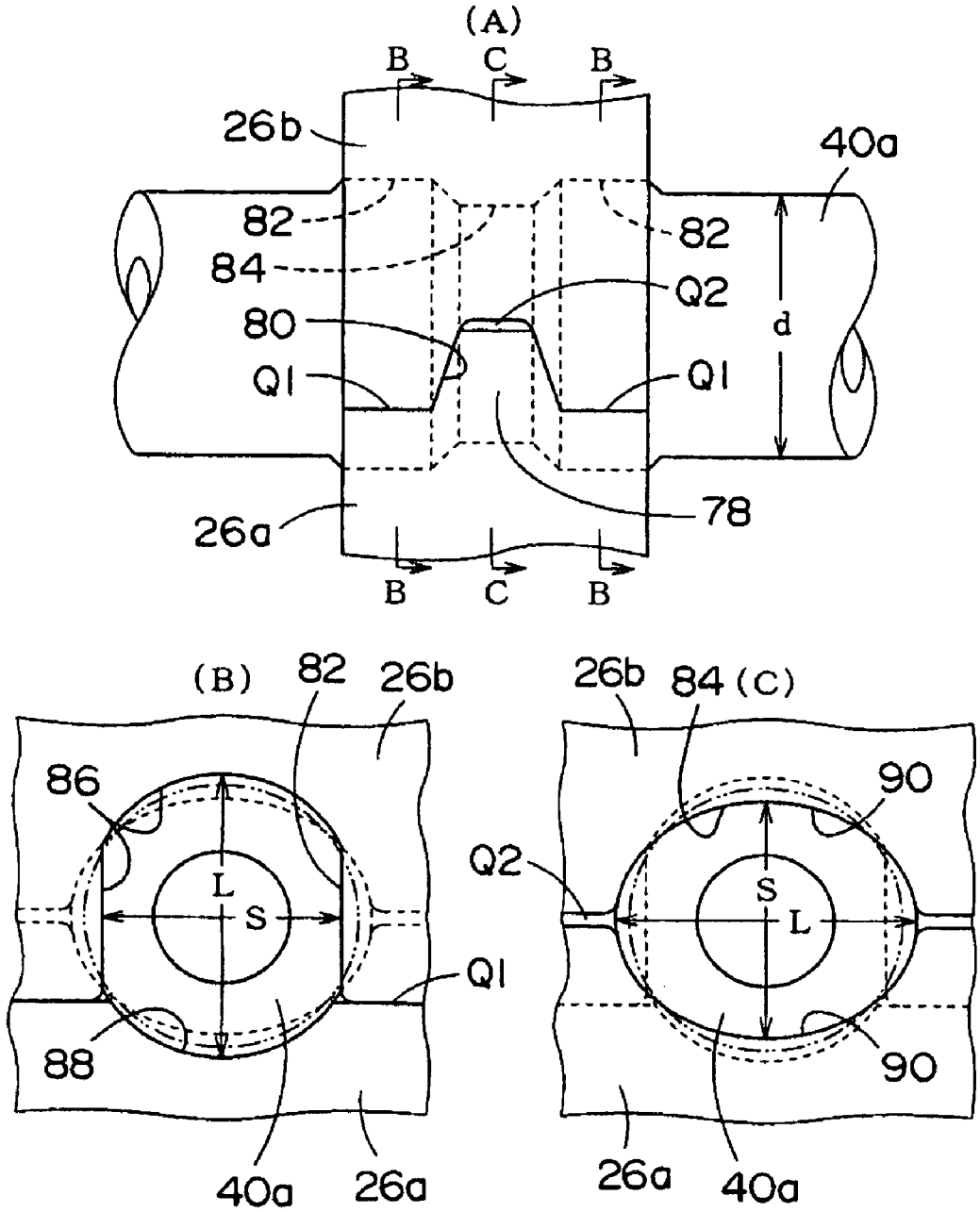
FIG. 10 is views showing one example of a waterproof construction of a portion in which an electric wire is held of the electronic part incorporating connector shown in FIG. 1, FIG. 10(A) being a sectional view taken from the front side, FIG. 10(B) being a sectional view taken along the line B-B of FIG. 10(A), and FIG. 10(C) being a sectional view taken along the line C-C of FIG. 10(A)
Figure 11:
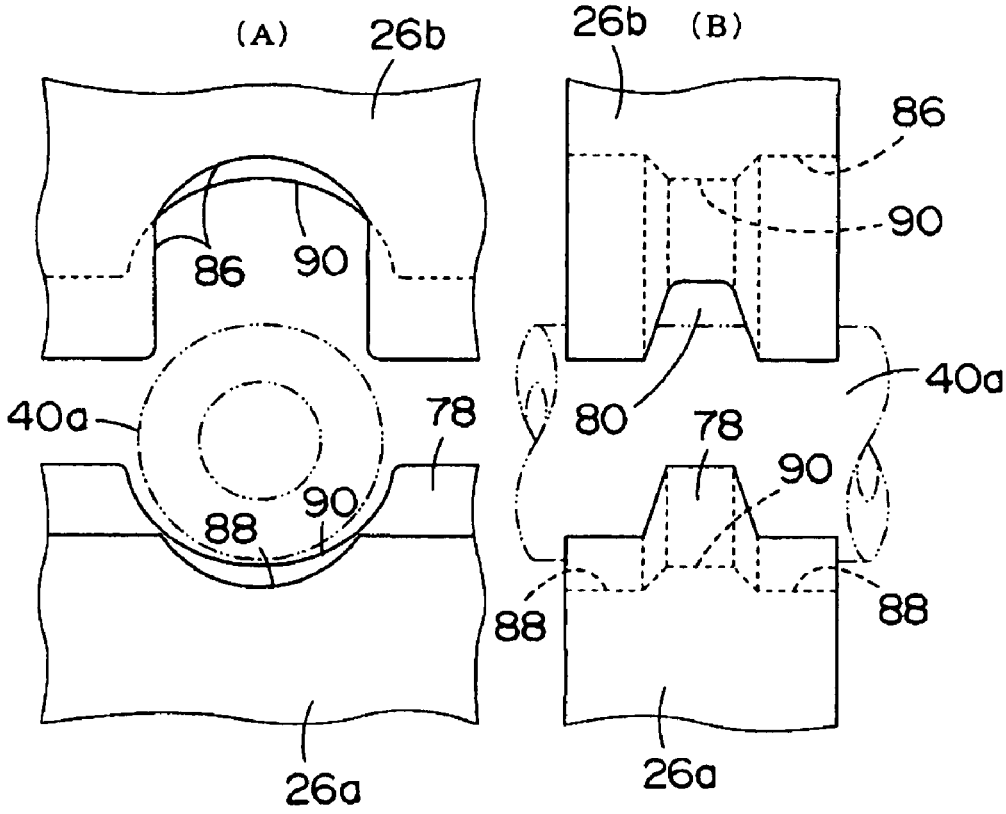
FIG. 11 is views showing a state before a lid is closed of the waterproof construction shown in FIG. 10, FIG. 11(A) being a sectional view taken from the front side, FIG. 11(B) being a sectional view taken along the line B-B of FIG. 11(A)

FIGS. 10 and 11 show one means for securing waterproofness of the joint Q between the body 26*a* and the lid 26*b*. FIG. 10 shows a state in which the lid 26*b* is closed, and FIG. 11 shows a state before the lid 26*b* is closed. A portion in which the wires are not held of the joint between the body 26*a* and the lid 26*b* can secure waterproofness of a degree of drip-proofness by forming a difference in height in the wall thickness direction. Specifically, the joint between the body 26*a* and the lid 26*b* is divided into three in the wall thickness direction, and a difference in height is provided so that the positions of joints Q1 at both sides are lower than the position of a middle joint Q2, by which the intrusion passage of water is shut off by the height difference surface. In other words, a protrusion 78 is formed on the body 26*a* side of the joint and a groove 80 is formed on the lid 26*b* side, and the protrusion 78 is fitted in the groove 80, by which the intrusion passage of water is shut off.

On the other hand, a portion in which the wires are held is constructed as described below. The portion in which the wires are held is divided into three in the wall thickness direction, longitudinally long elliptical passages 82 in which the major axis is directed to the direction perpendicular to the direction of joint between the body and the lid are provided at both end sides in the wall thickness direction and a transversely long elliptical passage 84 in which the major axis is directed to the direction of the joint is provided in a middle portion in the wall thickness direction (the longitudinally long elliptical passage 82 and the transversely long elliptical passage 84 are provided alternately in the wall thickness direction), and the major axis length L of the longitudinally long elliptical passage 82 and the transversely long elliptical passage 84 is set so as to be larger than the outside diameter d of wire and the minor axis length S thereof is set so as to be smaller than the outside diameter d of wire. However, the cross-sectional area of the longitudinally long elliptical passage 82 and the transversely long elliptical passage 84 is set so as to be almost the same as the cross-sectional area of the electric wire 40*a*.

Also, the longitudinally long elliptical passage 82 is formed by a combination of a substantially inverse U shaped deep groove 86 formed in the wall on the lid 26*b* side of the joint Q1 and a shallow groove 88 formed in the wall on the body 26*a* side, and the transversely long elliptical passage 84 is formed by a combination of semi-elliptical grooves 90, 90 formed in the walls at both sides of the joint Q2 so as to have the same depth. The longitudinally long elliptical passage 82 and the transversely long elliptical passage 84 are formed so that the center axis lines coincide with each other in the state in which the lid 26*b* is closed. Also, the joint Q2 at both sides of the transversely long elliptical passage 84 is formed so that a gap is provided in the state in which the lid 26*b* is closed. In FIGS. 10(B) and 10(C), the two-dot chain line indicates the cross section (circular) of wire before being compressed.

That is to say, in this embodiment 2, a portion other than a wire pull-out portion (holding portion) of the joint between the body 26*a* and the lid 26*b* is provided with a difference in height so that the height position of joint changes in the wall thickness direction, and the longitudinally long elliptical passage 82 and the transversely long elliptical passage 84 in the wire pull-out portion are provided so as to correspond to the change of height position of the joint in the portion other than the wire pull-out portion (the longitudinally long elliptical passage 82 is provided in the wall thickness portion in which the height position of joint is low and the transversely long elliptical passage 84 is provided in the wall thickness portion in which the height position of joint is high). In other words, the transversely long elliptical passage 84 is provided in the wall thickness portion in which the height position of joint has almost the same height as that of the center of a hole in the wire pull-out portion, and the longitudinally long elliptical passage 82 is provided in the wall thickness portion in which the height position of joint has a height different from the height of the center of the hole in the wire pull-out portion. In this case, at least one of the height positions (Q1 and Q2 in FIG. 10) of joint between the body 26*a* and the lid 26*b* desirably has almost the same height as that of the center of the hole in the wire pull-out portion.

The reason why waterproofness can be obtained by the above-described configuration is as follows. First, in the state in which the lid 26*b* is opened as shown in FIG. 11, the electric wire 40*a* is placed above the semi-elliptical groove 90 on the lower side. Subsequently, when the lid 26*b* is closed, the electric wire 40*a* is pushed into the substantially inverse U shaped deep groove 86, and is collapsed from the upside and the downside by the semi-elliptical grooves 90, 90. The both side edges of the substantially inverse U shaped deep groove 86 are chamfered so that the wire is easily pushed in. Finally, as shown in FIG. 10, the electric wire 40*a* is compressedly deformed into a longitudinally long elliptical shape in cross section in the longitudinally long elliptical passage 82 and into a transversely long elliptical shape in cross section in the transversely long elliptical passage 84. Therefore, the intrusion passage of water is shut off in a portion in which the cross-sectional shape of the electric wire 40*a* changes from the longitudinally long elliptical shape to the transversely long elliptical shape, so that water is prevented from intruding.

Figure 12:
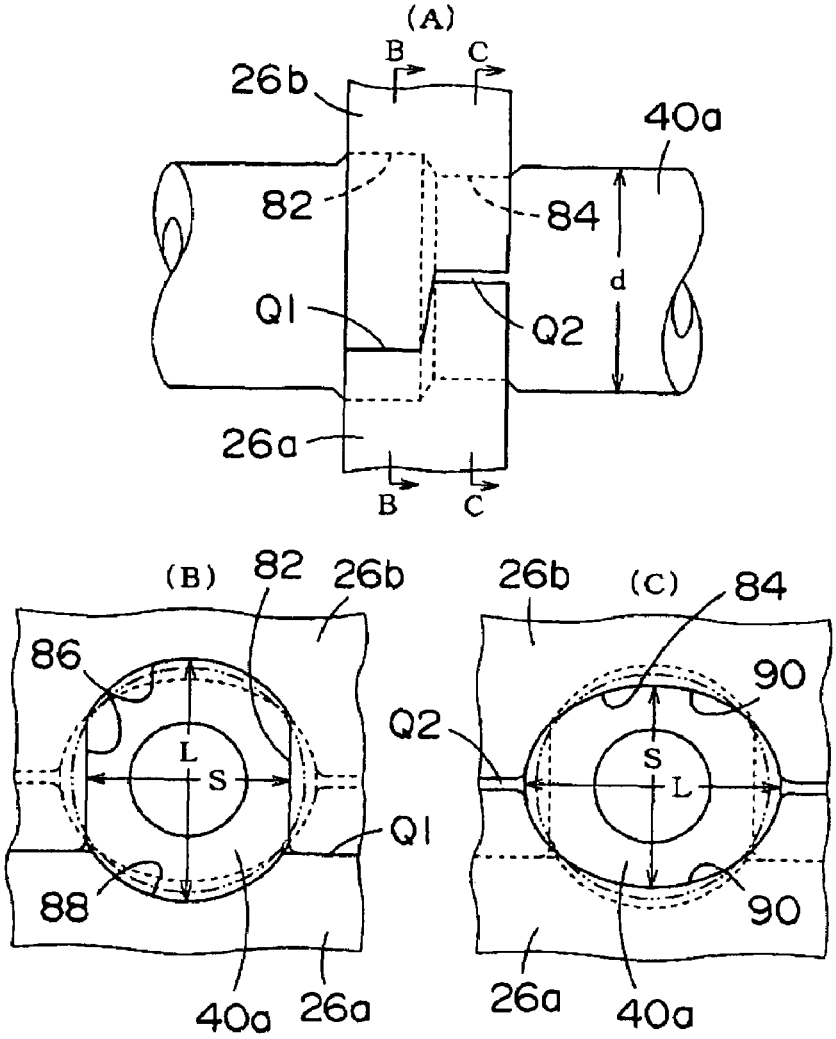
FIG. 12 is views showing another example of a waterproof construction of a portion in which an electric wire is held of the electronic part incorporating connector shown in FIG. 1, FIG. 12(A) being a sectional view taken from the front side, FIG. 12(B) being a sectional view taken along the line B-B of FIG. 12(A), and FIG. 12(C) being a sectional view taken along the line C-C of FIG. 12(A)

FIG. 12 shows another means for securing waterproofness of the joint Q between the body 26*a* and the lid 26*b*.

In the example shown in FIG. 10, the joint between the body 26*a* and the lid 26*b* is divided into three in the wall thickness direction. By contrast, in this example, the joint between the body 26*a* and the lid 26*b* is divided into two in the wall thickness direction. Specifically, a portion in which the wires are not held of the joint between the body 26*a* and the lid 26*b* is divided into two in the wall thickness direction, and a difference in height is provided so that a joint Q1 on the outside is lower than a joint Q2 on the inside, by which the intrusion passage of water is shut off by the height difference surface.

On the other hand, a portion in which the wires are held is constructed as described below. The portion in which the wires are held is divided into two in the wall thickness direction, and the longitudinally long elliptical passage 82 is provided on one side (the outer surface side of the second housing) in the wall thickness direction and the transversely long elliptical passage 84 is provided on the opposite side (the inner surface side) (the longitudinally long elliptical passage 82 and the transversely long elliptical passage 84 are provided alternately in the wall thickness direction). This example is the same as the example shown in FIG. 10 in that the major axis length L of the longitudinally long elliptical passage 82 and the transversely long elliptical passage 84 is set so as to be larger than the outside diameter d of wire and the minor axis length S is set so as to be smaller than the outside diameter d of wire, and that the cross-sectional area of the longitudinally long elliptical passage 82 and the transversely long elliptical passage 84 is set so as to be almost the same as the cross-sectional area of the electric wire 40*a*.

Also, this example is the same as the example shown in FIG. 10 in that the longitudinally long elliptical passage 82 is formed by a combination of the substantially inverse U shaped deep groove 86 formed in the wall on one side (on the lid 26*b* side) of the joint Q1 and the shallow groove 88 formed in the wall on the opposite side (on the body 26*a* side), and the transversely long elliptical passage 84 is formed by a combination of the semi-elliptical grooves 90, 90 formed in the walls at both sides of the joint Q2 so as to have the same depth, that the longitudinally long elliptical passage 82 and the transversely long elliptical passage 84 are formed so that the center axis lines coincide with each other in the state in which the lid 26*b* is closed, and that the joint Q2 at both sides of the transversely long elliptical passage 84 is formed so that a gap is provided in the state in which the lid 26*b* is closed.

Even in such a configuration, the intrusion passage of water can be shut off for the same reason as that of the example shown in FIG. 10.

According to the present invention, since the housing is divided into the first housing for housing the electronic part and the second housing for housing the connecting part that connects the leads of the electronic parts to the electric wires, the assembly on the first housing side and the assembly on the second housing side are accomplished in separate processes, and the inspection is carried out independently, and thereafter nondefective products are connected to each other at the final stage of the assembling process, by which a finished product can be obtained.

Therefore, the yield of process is improved. Also, if a trouble is found after the finished product has been manufactured, the first and second housings are disconnected from each other, by which the electronic part is recovered easily and can be reused, so that the cost can be reduced.

The wiring harness with electronic part incorporating connector is configured so that the plurality of electric wires are caused to run long in parallel to provide one combination wire, and many electronic part incorporating connectors are installed at desired locations in intermediate positions of the combination wire, so that if any one of the electronic part incorporating connectors fails, the whole of the combination wire becomes useless, and if the electronic part incorporating connector is removed from the electric wire, the combination wire cannot be reused. The wiring harness with electronic part incorporating connector in accordance with the present invention is configured so that the housing is divided into the first and second housings, and the expensive electronic part is housed in the housing separate from the housing on the wire side. Therefore, if the electronic part fails, the defective electronic part can be replaced with a nondefective part one by one, and if a trouble occurs on the wire side, all of the electronic parts can be recovered and reused.

Also, the assembling process on the first housing side for handling electronic parts and the assembling process on the second housing side for handling long electric wires can be performed on separate lines. Therefore, each of the assembling processes is simplified, and the assembly using automation equipment is easy. Also, even in the case where the assembly is accomplished manually, only a local process requires means against static electricity in the case where bare ICs are handled, so that the equipment cost can be reduced. Also, in the process for handling electric wires, since the electronic part such as an IC is housed in the first housing, and the first and second housings are merely connected at the final stage of the process, mechanical and electrical loads imposed on the electronic part by the assembling work can be alleviated.

Also, if the second housing is divided into the body and the lid, a jig or a tool can be inserted from both surfaces of the body. Therefore, for example, when the electric wire is connected to the solderless terminal, the connecting workability is improved, and also a mechanical load on the second housing can be alleviated.

Also, if the bus bar connector integrally having the solderless terminal connected under pressure to the electric wire and the female terminal to which the wire-side lead of electronic part is connected is used as a wire-side connecting part, the electric wire and the wire-side lead of electronic part can be connected to each other easily.

Also, if the second housing is divided into the body and the lid so that the electric wires are held by the body and the lid, the joint between the first and second housings can be formed in a plane shape regardless of the arrangement of electric wires. Therefore, the joint between the first and second housings can easily be made drip-proof. Also, since the electric wire can be held firmly, the second housing can be fixed easily to the electric wires.

Also, if the electric wire pressing element having the positioning portion for the bus bar connector is incorporated in the second housing, and the bus bar connector is positioned and temporarily locked to the electric wire pressing element and then is fixed, by which the bus bar connector is connected under pressure to the electric wire, the bus bar connector and the electric wire can be connected to each other easily and surely.

Also, if the inspection contact for performing the continuity test between the bus bar connector and the lead of electronic part is provided, the judgment whether the assembly of the second housing has been accomplished completely can made easily by the continuity test between the bus bar connector and the electric wire or part lead.

Also, in the portion in which the body and the lid hold the electric wires, the longitudinally long elliptical passage in which the major axis is directed to the direction perpendicular to the direction of joint between the body and the lid and the transversely long elliptical passage in which the major axis is directed to the direction of the joint are provided alternately in the wall thickness direction of that portion, and the major axis length of the longitudinally long elliptical passage and the transversely long elliptical passage is set so as to be larger than the outside diameter of electric wire and the minor axis length thereof is set so as to be smaller than the outside diameter of electric wire. Thereby, the waterproofness of the wire pull-out portion can be enhanced.

Also, the joint between the body and the lid of the second housing is divided into plural numbers in the wall thickness direction, and the height positions of the joints adjacent in the wall thickness direction are made different. This configuration also offers an advantage that water is less liable to intrude from the joint, and hence the waterproofness is enhanced effectively.

Also, if the two-way female connecting terminal is used as an equipment-side connecting part in the first housing, the equipment-side leads of electronic part are inserted in the two-way female connecting terminal from one end side, and the male terminals of the equipment-side connector are inserted from the other end side. Therefore, the two-way female connecting terminal receives an inserting/drawing force of male terminal, and no inserting/drawing force of male terminal is applied to the equipment-side leads of electronic part, so that the electronic part can be protected surely. Also, in the case where the necessity of removing the electronic part housed in the first housing for any reason arises, the electronic part can be removed easily from the first housing.

What is claimed is:

1. An electronic part incorporating a connector, comprising:

a housing;

an electronic part; and a connecting part configured to connect a lead of the electronic part to an electric wire housed in the housing, wherein the housing is divided into a first housing configured to house the electronic part and a second housing configured to house the connecting part, and the lead of the electronic part is connected to the connecting part by the connection of the first housing and the second housing.

2. An electronic part incorporating a connector, comprising:

a housing;

an electronic part having an equipment-side lead and a wire-side lead;

an equipment-side connecting part configured to connect the equipment-side lead of the electronic part to an equipment-side connector; and a wire-side connecting part configured to connect the wire-side lead of the electronic part to an electric wire, housed in the housing, wherein the housing is divided into a first housing configured to house the electronic part and the equipment-side connecting part and a second housing configured to house the wire-side connecting part, and the wire-side lead of the electronic part is connected to the wire-side connecting part by the connection of the first housing and the second housing.

3. The electronic part incorporating a connector according to claim 2, wherein the wire-side connecting part is a bus bar connector integrally having a solderless terminal connected under pressure to the electric wire and a female terminal to which the wire-side lead of the electronic part is connected.

4. The electronic part incorporating a connector according to claim 3, wherein the second housing is divided into a body and a lid so that the electric wire passing through the second housing is held by the body and the lid.

5. The electronic part incorporating a connector according to claim 3, wherein an electric wire pressing element having a positioning portion for the bus bar connector is incorporated in the second housing, and the bus bar connector is positioned and temporarily locked to the electric wire pressing element and then is fixed, by which the bus bar connector is connected under pressure to the electric wire.

6. The electronic part incorporating a connector according to claim 3, wherein an inspection contact configured to perform a continuity test between the bus bar connector and the lead of the electronic part is provided in the bus bar connector.

7. The electronic part incorporating a connector according to claim 1, wherein in a portion in which a body and a lid of the second housing hold the electric wire, a longitudinally long elliptical passage in which a major axis is directed perpendicular to a direction of a joint between the body and the lid and a transversely long elliptical passage in which the major axis is directed to the direction of the joint are provided alternately in a wall thickness direction of that portion, and a major axis length of the longitudinally long elliptical passage and the transversely long elliptical passage is larger than an outside diameter of the electric wire and a minor axis length thereof is smaller than the outside diameter of the electric wire.

8. The electronic part incorporating a connector according to claim 7, wherein the joint between the body and the lid of the second housing is divided into plural numbers in the wall thickness direction, and height positions of the joint that are adjacent in the wall thickness direction are different.

9. The electronic part incorporating a connector according to claim 7, wherein a portion other than a wire pull-out portion of the joint between the body and the lid of the second housing is provided with a difference in height so that height positions of the joint change in the wall thickness direction, and the longitudinally long elliptical passage and the transversely long elliptical passage in the wire pull-out portion are provided so as to correspond to the change of the height positions of the joint in the portion other than the wire pull-out portion.

10. The electronic part incorporating a connector according to claim 2, wherein in a portion in which a body and a lid of the second housing hold the electric wire, a longitudinally long elliptical passage in which a major axis is directed perpendicular to a direction of a joint between the body and the lid and a transversely long elliptical passage in which the major axis is directed to the direction of the joint are provided alternately in a wall thickness direction of that portion, and a major axis length of the longitudinally long elliptical passage and the transversely long elliptical passage is larger than an outside diameter of the electric wire and a minor axis length thereof is smaller than the outside diameter of the electric wire.

11. The electronic part incorporating a connector according to claim 10, wherein the joint between the body and the lid of the second housing is divided into plural numbers in the wall thickness direction, and height positions of the joint that are adjacent in the wall thickness direction are different.

12. The electronic part incorporating a connector according to claim 10, wherein a portion other than a wire pull-out portion of the joint between the body and the lid of the second housing is provided with a difference in height so that height positions of the joint change in the wall thickness direction, and the longitudinally long elliptical passage and the transversely long elliptical passage in the wire pull-out portion are provided so as to correspond to the change of the height positions of the joint in the portion other than the wire pull-out portion.

13. The electronic part incorporating a connector according to claim 2, wherein the equipment-side connecting part is a two-way female connecting terminal provided alternately with an insertion portion for the equipment-side lead of the electronic part and an insertion portion for a male terminal of the equipment-side connector.

14. A wiring harness with an electronic part incorporating a connector, wherein a plurality of the electronic part incorporating a connector according to any one of claims 1 to 13 are installed on a combination wire consisting of a plurality of electric wires at desired intervals in a lengthwise direction.

* * * * *